United States Patent [19]

Bartels et al.

[11] Patent Number: 4,880,376

[45] Date of Patent: Nov. 14, 1989

[54] METHOD AND APPARATUS FOR MONITORING AND CALIBRATING DAMPER POSITION

[75] Inventors: James I. Bartels, Hudson, Wis.; Paul B. Patton, Rockford, Minn.; Kenneth B. Kidder, Coon Rapids, Minn.; Alfred J. Gaskell, Hopkins, Minn.

[73] Assignee: Honeywell Inc., Minneapolis, Minn.

[21] Appl. No.: 303,360

[22] Filed: Jan. 27, 1989

[51] Int. Cl.[4] ..... F23N 3/00

[52] U.S. Cl. ..... 431/12; 431/17; 431/20; 126/285 R; 110/163

[58] Field of Search ..... 431/13, 14, 18, 20, 431/12, 17; 236/1 G, 45; 126/285 R, 285 B; 110/147, 163

[56] References Cited

U.S. PATENT DOCUMENTS

| | | | |
|---|---|---|---|
| 4,267,819 | 5/1981 | Claesson | 126/285 |
| 4,299,554 | 11/1981 | Williams | 431/16 |
| 4,330,261 | 5/1982 | Sun | 431/14 |
| 4,374,569 | 2/1983 | Hayes | 236/1 |
| 4,439,139 | 3/1984 | Nelson et al. | 431/20 |
| 4,439,140 | 3/1984 | Stout | 431/31 |
| 4,450,344 | 5/1984 | Sakoda et al. | 431/20 X |
| 4,474,549 | 10/1984 | Capone | 431/12 |
| 4,489,376 | 12/1984 | Putman | 364/165 |

*Primary Examiner*—Margaret A. Focarino
*Attorney, Agent, or Firm*—Kinney & Lange

[57] ABSTRACT

Damper position of a damper in a heating system is monitored. The damper is movable between end positions in response to movement of a motor shaft. The motor shaft moves in response to a movement request signal. A shaft position signal is received by a position detector and has a value representative of position of the motor shaft. When the damper reaches an end position, it is determined whether the value of the shaft position signal is within a predetermined tolerance. If it is outside of the tolerance, then the system is shut down as unreliable; otherwise, the shaft position signal is recalibrated to maintain accuracy.

30 Claims, 2 Drawing Sheets

METHOD AND APPARATUS FOR MONITORING AND CALIBRATING DAMPER POSITION

BACKGROUND OF THE INVENTION

1. Field of the Invention

This invention relates to monitoring damper position. More particularly, this invention relates to monitoring and calibrating damper position of a damper in a heating system.

2. Description of the Prior Art

In a heating system, fuel and combustion air are generally provided to a combustion chamber where they are ignited and burned. Fuel and air supplies are controlled by a modulation motor which rotates air damper and fuel valve shafts between a closed position (a low fire position) and an open position (a high fire position). Modulation of the rate that an air and fuel mixture is supplied to the combustion chamber (the firing rate) is accomplished by operating the air damper and fuel valve shafts between the low fire and high fire positions.

In the past, the firing rate has been controlled by crude, electromechanical devices. High fire and low fire position information was provided to a heating system controller by limit switches which were activated by cams mounted on the modulation motor shaft. However, the cams were mounted on the motor shaft at operating angles which were adjustable and could, therefore, be misadjusted. A misadjusted operating angle could lead to a false indication of a high fire or low fire position to the heating system controller. This, in turn, could lead to insufficient purging of the combustion chamber at start-up or to ignition at a high gas flow-rate. Both of these situations are undesirable. In addition to safety concerns, position accuracy is poor in this type of damper control.

Therefore, there is a need for a damper control system which is both safe and which maintains position accuracy.

SUMMARY OF THE INVENTION

With the present invention, damper position of damper means which control flow of combustion air or fuel in a heating system is monitored and calibrated on an automatic basis. The damper means is movable between end positions in response to movement of a motor shaft. The motor shaft, in turn, moves in response to a movement request signal. A shaft position signal is received by position detector means and has a value representative of position of the motor shaft. When the damper means reaches an end position, it is determined whether the value of the shaft position signal is within a predetermined tolerance.

DETAILED DESCRIPTION OF THE PREFERRED EMBODIMENTS

Figure 1:
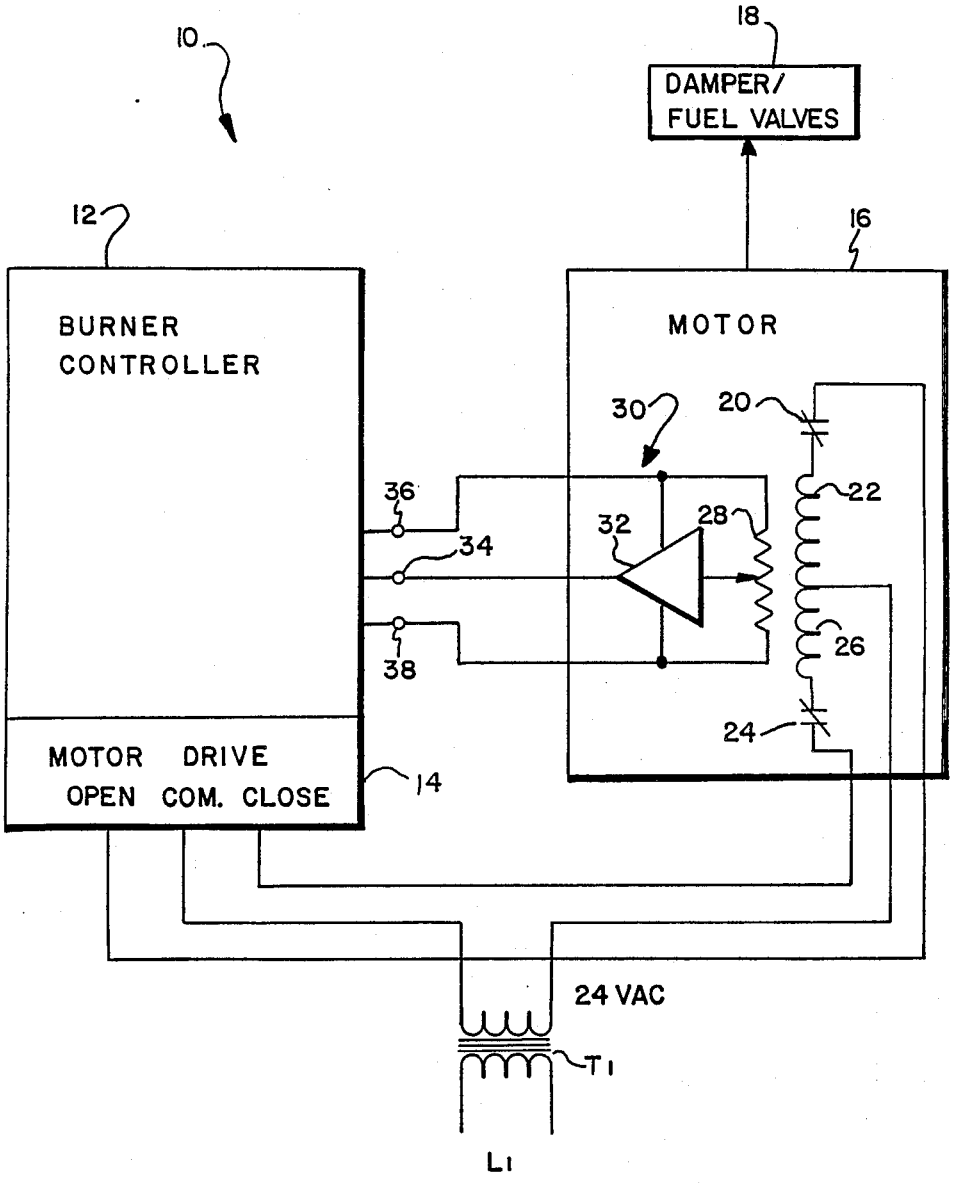
FIG. 1 is a schematic diagram of a portion of a heating system.

FIG. 1 is a schematic diagram of monitoring system 10. Monitoring system 10 comprises burner controller 12. motor drive 14, transformer T1, motor !6 and damper/fuel valves 18. Burner controller 12 receives various inputs such as operator inputs and sensor inputs and determines a firing rate. Based on that firing rate, it commands motor drive 14 to operate motor 16 so that damper/fuel valves 18 are opened or closed in a manner consistent with the firing rate determined by burner controller 12.

Line voltage L1 is stepped down by transformer T1 and supplied, in this preferred embodiment as 24 volts AC, to monitoring system 10 at a common terminal at motor drive 14 and an energized terminal at motor 16. An "Open" terminal and a "Close" terminal are energized by motor drive 14 based on the commands of burner controller 12. When burner controller 12 commands motor drive 14 to operate motor 16 so that damper/fuel valves 18 are open, motor drive 14 energizes the Open terminal and completes a line voltage circuit through high fire end switch 20 and open coil 22. When the line voltage circuit is completed through open coil 22, a motor shaft in motor 16 rotates opening a selected damper or fuel valve in damper/fuel valves 18. Cams are mounted on the motor shaft of motor 16 to actuate high fire end switch 20 when the motor shaft is in a predetermined high fire position. When high fire end switch 20 opened, the line voltage circuit is broken and the motor shaft is stopped.

Figure 2:
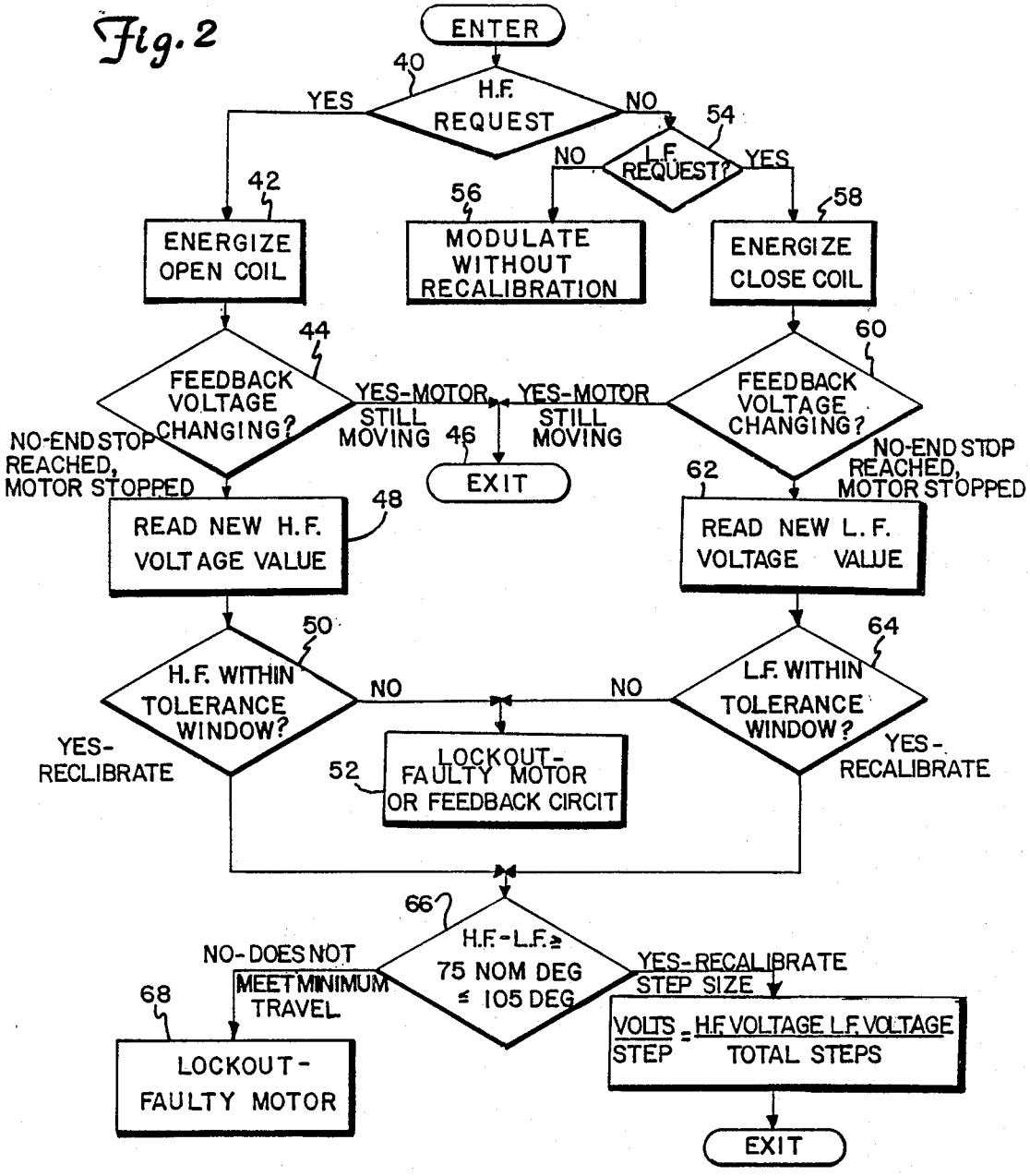
FIG. 2 is a flow diagram of the process of the present invention.

Similarly, when burner controller 12 commands motor drive 14 to operate motor 16 so that a selected damper or fuel valve and damper/fuel valves 18 closes, the "close" terminal in motor drive 14 is energized completing a line voltage circuit across low fire switch 24 and close coil 26. This causes the motor shaft in motor 16 to rotate so that the selected damper or fuel valve in damper/fuel valves 18 closes. When the selected damper or fuel valve reaches the low fire position, a cam, mounted on the motor shaft in motor 16 opens low fire end switch 24 stopping the motor shaft. Potentiometer 28 is also coupled to the motor shaft of motor 16 and is connected to feedback circuit 30. Its wiper voltage, which varies with the motor shaft position of motor 16 and which corresponds to the position of the selected damper or fuel valve at damper/fuel valves 18, is provided to amplifier 32. Amplifier 32, in turn, provides a shaft position feedback signal to burner controller 12 at feedback terminal 34. Also, a reference voltage is provided to feedback circuit 30 at reference voltage nodes 36 and 38. FIG. 2 is a flow diagram of the monitoring system of the present invention. Burner controller 12 determines whether to command motor drive 14 for a high fire request or a low fire request or neither. If a high fire request is generated, then open coil 22 is energized. The feedback voltage at feedback node 24 is monitored to determine if it is still changing. If it is, then the motor shaft (as well as the damper or fuel valve) is still moving and burner controller 12 exits to wait until it is no longer moving. This is shown by blocks 40, 42, 44, and 46. However, if the feedback voltage at feedback node 34 is no longer changing, then high fire end switch 20 has opened causing the motor shaft in motor 16 (and the corresponding damper or fuel valve) to stop. In that case, burner controller 12 reads the feedback voltage at feedback node 34 and compares it with an expected high fire calibration voltage. A reasonable tolerance is allowed when preforming this comparison, to avoid nuisance shutdowns. However, if the feedback voltage at node 34 is not within the tolerance, then either the motor stopped at an incorrect position which would indicate that the mechanical endstops are not properly adjusted, or feedback circuit 30 has failed. In either case, burner controller 12 will shutdown the heating system and activate an alarm. This is indicated in blocks 48, 50 and 52.

If, at block 40, burner controller 12 does not issue a high fire request, it may either issue a low fire request or a modulation request which does not require the damper or fuel valve to go to either the high fire or the low fire position. In that case, the damper or fuel valve is simply modulated. This is indicated in blocks 54 and 56.

If, on the other hand, a low fire request is issued, operation is similar to that when a high fire request is issued. Close coil 26 is energized and the feedback voltage at feedback node 34 is monitored to determined when it stops changing. When it does, that indicates that the motor shaft has rotated to the low fire position and the feedback voltage at feedback node 34 is read by burner controller 12. The feedback voltage is then compared with an expected low fire calibration voltage to determine whether it is within an allowed tolerance. If not, as in the case of a high fire request, either the mechanical endstop or feedback circuit 30 has malfunctioned and a safety shutdown state is entered. This is indicated in blocks 58, 60, 62 and 64.

Total tolerance can build up in monitoring system 10 which can lead to the selected damper or fuel valve travelling an unacceptably short or long distance. Therefore, a total travel test is imposed on monitoring system 10. In this preferred embodiment, the total travel test is designed to ensure that the selected damper or fuel valve travels a minimum of 75° between the low fire and high fire positions and a maximum of 105°.

There are a predetermined number of steps which correspond to damper positions between these low fire and high fire positions. Each step corresponds to a feedback voltage from feedback terminal 34. Controller 12 subtracts the feedback voltage read from feedback terminal 34 during the most recent low fire positioning from the feedback voltage read at feedback terminal 34 during the most recent high fire positioning. Based upon this difference and upon an initial default unit step size, burner controller 12 determines the total number of degrees which the selected damper or fuel valve must travel in order to move from the low fire position to the high fire position. If it does not meet the minimum travel distance, a safety shutdown state is entered. This is indicated in block 66 and block 68. However, if the minimum travel distance is met, burner controller 12 runs a recalibration routine. Tolerance buildup and wear over time can cause a wide swing in the relationship between the feedback voltage seen at feedback node 34 and the angle of the motor shaft in motor !6. In this preferred embodiment, position accuracy is maintained by recalibrating a position equation used by burner controller 12 in positioning the motor shaft. Each time the motor shaft travels either to the high fire or to the low fire position (assuming the feedback voltage is within the tolerance window and satisfies the total travel test), a high fire and low fire voltage are set to equal the feedback voltage monitored at node 34 during the corresponding high or low fire position. The volts per unit step used to position the motor shaft in motor 16 is then calculated as follows:

$$\text{voltage/step} = \frac{\text{high fire feedback} - \text{low fire feedback}}{\text{total \# steps}} \qquad (1)$$

This active calibration assures position accuracy until either the feedback voltages read during the high fire or low fire positions fall outside of the tolerance window at which time the system is determined to be unreliable and is shutdown or, until the damper fails to meet the total travel test.

It should be noted that feedback circuit 30 need not be a potentiometer but could be another position detection means. For example, an optical encoder could be used instead of a feedback potentiometer. Voltage at feedback node 34 would then be replaced with counts. However, the concept remains unchanged.

CONCLUSION

This method of position control provides a cross check between mechanical endstops and electrical feedback position detection. This enhances system safety with respect to motor positioning errors.

Additionally, active calibration is used to assure position accuracy of the damper or fuel valve. Also a total travel test is used to assure that the damper travelled more than a minimum threshold distance between low fire and high fire positions but less than a maximum threshold distance. This ensures a sufficient amount of air flow to the combustion chamber in the heating system for safe operation.

Although the present invention has been described with reference to preferred embodiments, workers skilled in the art will recognize that changes may be made in form and detail without departing from the spirit and scope of the invention.

What is claimed is:

1. A method for monitoring damper position of damper means which control flow of combustion air or fuel in a heating system where the damper means is movable between first and second end positions in response to movement of a motor shaft where the motor shaft moves in response to a movement request signal, the method comprising:

receiving a shaft position signal provided by continuous position detector means and having a value representative of position of the motor shaft;

stopping the motor shaft when the damper means reaches an end position; and determining whether the value of the shaft position signal is within a predetermined tolerance when the damper means reaches the first and second end position.

2. The method of claim and further comprising:

entering a safety shutdown state when the value of the shaft position signal is outside the predetermined tolerance when the damper means has reached an end position.

3. The method of claim 1 wherein the damper means is determined to be at an end position when the movement request signal commands the motor shaft to move the damper means to an end position and when the shaft position signal is no longer changing.

4. A method for monitoring damper position of damper means which control flow of combustion air or fuel in a heating system where the damper means is movable between first and second end positions in response to movement of a motor shaft where the motor shaft moves in response to a movement request signal, the method comprising:

receiving a shaft position signal provided by position detector means and having a value representative of position of the motor shaft; and determining movement range of the damper means, to ensure that the movement range is within a predetermined range, based on the values of the shaft position signal when the damper means reaches the first and second end positions.

5. The method of claim 4 wherein the step of determining movement range further comprises : determining the difference between damper position when the damper means reaches the first end position and when the damper means reaches the second end position based on the value of the shaft position signal when the damper means reaches the first and second end positions respectively; and comparing the difference to the predetermined range.

6. The method of claim 4 and further comprising: entering a safety shutdown state when the movement range is outside the predetermined range.

7. The method of claim 4 wherein the damper means is determined to be at one of the end positions when the movement request signal commands the motor shaft to move the damper means to that end position and when the shaft position signal is no longer changing.

8. A method for monitoring damper position of damper means which control flow of combustion air or fuel in a heating system where the damper means is movable, in a plurality of calibrated steps, between first and second end positions in response to movement of a motor shaft where the motor shaft moves in response to a movement request signal, the method comprising:

receiving a shaft position signal provided by position detector means and having a value representative of position of the motor shaft; and recalibrating the calibrated steps based on the value of the shaft position signal when the damper means reaches the first and second end positions.

9. The method of claim 8 wherein the step of recalibrating the calibrated steps is performed each time the damper means reaches one of the end positions.

10. The method of claim 8 wherein the damper means is determined to be at one of the end positions when the movement request signal commands the motor shaft to move the damper means to that end position and when the shaft position signal is no longer changing.

11. The method of claim 8 and further comprising: determining whether the value of the shaft position signal is within a predetermined tolerance when the damper means reaches one of the end positions before performing the step of recalibrating.

12. The method of claim and further comprising: entering a safety shutdown state when the value of the shaft position signal is outside the predetermined tolerance when the damper means has reached an end position.

13. The method of claim and further comprising: determining movement range of the damper means, to ensure that the movement range is within a predetermined range, based on the values of the shaft position signal when the damper means reaches the first and second end positions.

14. The method of claim 13 wherein the step of determining movement range further comprises :

determining the difference between damper position when the damper means reaches the first end position and when the damper means reaches the second end position based on the value of the shaft position signal when the damper means reaches the first and second end positions, respectively; and comparing the difference to the predetermined range.

15. The method of claim 14 and further comprising: entering a safety shutdown state when the movement range is outside the predetermined range.

16. The apparatus of claim 15 and further comprising: means for determining that the damper is at one of the end positions when the movement request signal commands the motor shaft to move the damper means to that end position and when the shaft position signal is no longer changing.

17. An apparatus for monitoring damper position of damper means which control flow of combustion air or fuel in a heating system where the damper means is movable between first and second end positions in response to movement of a motor shaft where the motor shaft moves in response to a movement request signal, comprising:

means for receiving a shaft position signal provided by position detector means and having a value representative of position of the motor shaft;

means for stopping the motor shaft when the damper means reaches the end positions; and means for determining whether the value of the shaft position signal is within a predetermined tolerance when the damper means reaches one of the end positions.

18. The apparatus of claim 17 and further comprising: means for causing a safety shutdown state to be entered when the value of the shaft position signal is outside the predetermined tolerance when the damper means has reached on of the end positions.

19. An apparatus for monitoring damper position of damper means which control flow of combustion air or fuel in a heating system where the damper means is movable between end positions in response to movement of a motor shaft where the motor shaft moves in response to a movement request signal, the apparatus comprising:

means for receiving a shaft position signal provided by position detector means and having a value representative of position of the motor shaft; and means for determining movement range of the damper means, to ensure that the movement range is within a predetermined range, based on the values of the shaft position signal when the damper means reaches the end positions.

20. The apparatus of claim 19 wherein the means for determining movement range further comprises:

means for determining the difference between damper position when the damper means reaches the first end position and when the damper means reaches the second end position based on the value of the shaft position signal when the damper means reaches the first and second end positions, respectively; and means for comparing the difference to the predetermined range.

21. The apparatus of claim 19 and further comprising: means for causing a safety shutdown state to be entered when the movement range is outside the predetermined range.

22. The apparatus of claim 19 and further comprising: means for determining that damper means is at one of the end positions when the movement request signal commands the motor shaft to move the damper means to that end position and when the shaft position signal is no longer changing.

23. An apparatus for monitoring damper position of damper means which control flow of combustion air or fuel in a heating system where the damper means is movable, in a plurality of calibrated steps, between first and second end positions in response to movement of a motor shaft where the motor shaft moves in response to a movement request signal, the apparatus comprising:

means for receiving a shaft position signal provided by position detector means and having a value representative of position of the motor shaft; and means for recalibrating the calibrated steps based on the values of the shaft position signal when the damper means reaches the first and second end positions.

24. The apparatus of claim 23 wherein the means for recalibrating the calibrated steps recalibrates each time the damper means reaches one of the end positions.

25. The apparatus of claim 23 and further comprising:

means for determining whether the damper means is at one of the end positions when the movement request signal commands the motor shaft to move the damper means to that end position and when the shaft position signal is no longer changing.

26. The apparatus of claim 23 and further comprising:

means for determining whether the value of the shaft position signal is within a predetermined tolerance when the damper means reaches one of the end positions before performing the step of recalibrating.

27. The apparatus of claim 26 and further comprising:

means for causing a safety shutdown state to be entered when the value of the shaft position signal is outside the predetermined tolerance when the damper means has reached one of the end positions.

28. The apparatus of claim 26 and further comprising:

means for determining movement range of the damper means, to ensure that the movement range is within a predetermined range, based on the values of the shaft position signal when the damper means reaches the first and second end positions.

29. The apparatus of claim 28 wherein the means for determining movement range further comprises:

means for determining the difference between damper position when the damper means reaches the first end position and when the damper means reaches the second end position based on the value of the shaft position signal when the damper means reaches the first and second end positions, respectively; and means for comparing the difference to the predetermined range.

30. The apparatus of claim 29 and further comprising:

means for causing a safety shutdown state to be entered when the movement range is outside the predetermined range.

* * * * *

UNITED STATES PATENT AND TRADEMARK OFFICE

CERTIFICATE OF CORRECTION

PATENT NO. : 4,880,376

DATED : November 14, 1989

INVENTOR(S) : James I. Bartels et al.

It is certified that error appears in the above-identified patent and that said Letters Patent is hereby corrected as shown below:

Column 5, line 47, delete "claim" and insert --claim 11--.

Column 5, line 52, delete "claim" and insert --claim 11--.

Signed and Sealed this

Thirtieth Day of October, 1990

*Attest:*

*Attesting Officer*

HARRY F. MANBECK, JR.

*Commissioner of Patents and Trademarks*